US009330640B2

(12) United States Patent
Tsukada

(10) Patent No.: US 9,330,640 B2
(45) Date of Patent: May 3, 2016

(54) STRINGED INSTRUMENT PLAYING ASSISTANCE IMPLEMENT

(71) Applicant: Toshiki Tsukada, Hanishina-gun (JP)

(72) Inventor: Toshiki Tsukada, Hanishina-gun (JP)

( * ) Notice: Subject to any disclaimer, the term of this patent is extended or adjusted under 35 U.S.C. 154(b) by 0 days.

(21) Appl. No.: 14/437,588

(22) PCT Filed: Nov. 13, 2012

(86) PCT No.: PCT/JP2012/079402

§ 371 (c)(1),
(2) Date: Apr. 22, 2015

(87) PCT Pub. No.: WO2014/076768

PCT Pub. Date: May 22, 2014

(65) Prior Publication Data

US 2015/0287394 A1 Oct. 8, 2015

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 995,108 A * 6/1911 Aspegren ..... A61F 13/105 2/21
4,015,502 A * 4/1977 Strong ..... G10D 3/163 84/322
4,122,746 A * 10/1978 Freeman ..... G10D 3/163 84/322
4,497,237 A * 2/1985 Beall ..... G10D 3/163 84/322
4,899,557 A * 2/1990 Schwartz ..... A44C 15/008 63/15
5,894,097 A * 4/1999 Barry ..... G10D 3/163 84/322
8,395,038 B2 * 3/2013 Smith ..... G10D 3/163 84/322
9,135,898 B1 * 9/2015 McVicker ..... G10D 3/163
2015/0287394 A1 * 10/2015 Tsukada ..... G10D 3/163 84/322

FOREIGN PATENT DOCUMENTS

DE 44 00 421 A1 7/1995
JP 54-34720 U 3/1979
JP 2007-3665 A 1/2007
JP 2012-123350 A 6/2012

OTHER PUBLICATIONS

International Search Report, issued in PCT/JP2012/079402, dated Dec. 18, 2012.

* cited by examiner

*Primary Examiner* — Robert W Horn
(74) *Attorney, Agent, or Firm* — Birch, Stewart, Kolasch & Birch, LLP

(57) ABSTRACT

A stringed instrument playing assistance implement which can be altered and mounted on a finger, can be adjusted and make a perfect fit of a location, an angle, and a size for any sort of player's finger for preventing slippage or falling off said finger. The stringed instrument playing assistance implement can be altered and used for a variety of string picking techniques. The stringed instrument playing assistance implement is employed when playing a stringed instrument by picking the strings thereof and includes a wire-shaped member, which can be altered and mounted on a finger and which is capable of retaining a shape.

20 Claims, 11 Drawing Sheets

STRINGED INSTRUMENT PLAYING ASSISTANCE IMPLEMENT

FIELD OF TECHNOLOGY

The present invention relates to a stringed instrument playing assistance implement, more precisely relates to a stringed instrument playing assistance implement which is employed when playing a stringed instrument by picking the strings thereof.

BACKGROUND TECHNOLOGY

A stringed instrument is played by rubbing, picking or striking strings thereof, and the strings are directly touched by fingers or nails, or rubbed, picked or struck by a playing assistance implement. For example, a plectrum of a shamisen and a violin bow are used as playing assistance implements.

In case of playing a stringed instrument, e.g., guitar, it is possible to play the instrument by fingers or nails only, but a plying assistance implement, e.g., pick, is also generically used for playing the instrument. General picks are divided into a "mountable-type", e.g., finger pick, thumb pick, and a "holdable-type", e.g., flat pick.

Classic guitars are usually played by fingers or nails. However, in case of playing for a long time or playing a stringed instrument having metal strings, e.g., acoustic guitar, there is a possibility that skin or nails are abraded. To play a guitar without abrasion of skin or nails, the mountable-type pick, e.g., finger pick, thumb pick, is mounted on a finger for playing the guitar.

The style of playing with using fingers, nails or wearable-type instruments, e.g., finger pick, thumb pick, is generally called a finger style. In the finger style, strings are mainly picked by bending and stretching actions of fingers. A plurality of fingers are capable of picking a plurality of strings, so main melody and sub-melody can be simultaneously played. In case of mounting the finger pick or thumb pick, the finger style play with using a plurality of fingers can be performed. However, the bending and stretching actions of fingers are generally limited in one direction, so high-level playing performance is required for high speed playing, etc.

On the other hand, a style of holding a flat pick with two fingers or more, or a style of holding a mounted thumb pick as well as the flat pick is called a pick style. In the pick style, strings are mainly picked by bending and stretching actions or twisting actions of a wrist, or by bending and stretching actions of a forearm. In the pick style, each of strings can be picked from both sides thereof in order, so high speed playing can be performed. However, in the pick style, the pick is held and single or a plurality of strings are picked, in one action, by moving the wrist or the arm, so this style is not suitable for simultaneously playing a plurality of melodies.

These days, a variety of playing styles are performed by players, and some players perform a mixed style, in which playing is performed by using the pick, which is held by fingers, and other free fingers, but very high-level playing performance is required for performing the mixed style.

As to the above described playing assistance implements, a holdable plate-shaped pick for playing a stringed instrument is disclosed in Patent Document 1. A thumb pick which is mounted on a thumb for playing a stringed instrument is disclosed in Patent Document 2. A finger pick, in which a nail member is attached to a picking section, is disclosed in Patent Document 3.

PRIOR ART DOCUMENT

Patent Document

Patent Document 1: Japanese Laid-open Patent Publication No. 2012-123350

Patent Document 2: Japanese Laid-open Patent Publication No. 2007-3665

Patent Document 3: Japanese Laid-open Utility Model Publication No. 54-34720

SUMMARY OF THE INVENTION

Problems to be Solved by the Invention

An example of conventional thumb picks is shown in FIG. 10. In the conventional thumb pick which has been used as a mountable flat pick, a picking section is designed to be arranged parallel to a finger pad and fixed so as to pick strings, so a mounting angle of the thumb pick cannot be changed after mounting the thumb pick. In the pick style using the thumb pick, picking strings can be performed in a direction of an arrow without any difficulty. However, when the strings are picked, in a direction opposite to the direction of the arrow shown in FIG. 10, toward a near side of the player, i.e., an upper direction with respect to a guitar held by the player, the thumb pick itself will be introduced toward an inner side of the string and caught by the string according to a contact angle of the mounted thumb pick with respect to the string. With this accident, the picking action is often stopped. To prevent the thumb pick from being caught by the string of the guitar, the player should purposely change picking actions by bending and stretching a wrist or arm, or varying a twisting angle of the wrist or arm, and should pick the strings by the thumb pick at a suitable contact angle so as not to be introduced toward the inner side of the strings. Therefore, a structure of the thumb pick is not suitable for stroke performance, in which picking the strings are sequentially repeated from upward and downward, and is often unnatural from the view point of the human-factors engineering. A size of the thumb pick is fixed, so the player cannot change a holding style to a suitable style.

An example of conventional finger picks is shown in FIG. 11. In the conventional finger pick which is mounted on, for example, an index finger, a string-contact part, which can contact strings of a stringed instrument, is formed and corresponds to a part of the finger between a finger pad and a tip thereof, so the strings are picked, by the finger pad, only in a direction of an arrow shown in FIG. 11. Namely, the strings are picked by bending and stretching actions of the fingers, so a structure of the finger pick is not suitable for the stroke performance, etc., in which playing is performed by moving a wrist and a forearm. Further, a position of the string-contact part is fixed, and a size of most finger picks is fixed.

In case of using the flat pick disclosed in Patent Document 1, a player should pay attention to fatigue of fingers and muscle caused by holding the pick for a long time and slippage and dropping the pick caused by sweat when continuously holding the pick. Sizes and holding positions of the conventional mountable picks are almost fixed, so a player can hardly select an optimum size from the given sizes. Further, the thumb pick disclosed in Patent Document 2 is fitted and fixed to a thumb by a belt-like member, and a length of the belt-like member is adjusted by changing a clearance between grooves, but the length cannot be steplessly adjusted, so it is difficult to perfectly fit to the thumb of the player.

In case of the finger pick disclosed in Patent Document 3 too, a size is fixed.

Thus, the present invention has been invented to solve the above described problems, and an object of the present invention is to provide a stringed instrument playing assistance implement which can be altered and mounted on a finger, can be adjusted and make a perfect fit of a location, an angle, and a size for any sort of player's finger, can prevent slippage or falling off said finger, and can be altered and used for a variety of string picking techniques.

Means for Solving the Problems

To achieve the object, the stringed instrument playing assistance implement of the present invention has following structures. Namely, the stringed instrument playing assistance implement, which is employed when playing the stringed instrument by picking the strings thereof, comprises a wire-shaped member, which can be altered and mounted on a finger and which is capable of retaining a shape. With this structure, the wire-shaped member can be altered and formed into an optimum shape to make a perfect fit of sizes for player's finger and nail, can be mounted on the finger as the stringed instrument playing assistance implement, and can prevent slippage or falling off the finger.

Preferably, in the present invention, engage members, which can be engaged with each other, are integrally or separately provided to both ends of the wire-shaped member. With this structure, the wire-shaped member can be easily engaged with the finger by the engage members when the stringed instrument playing assistance implement is mounted on the finger, so a feeling of stability of the stringed instrument playing assistance implement on the finger can be improved.

Preferably, in the present invention, the wire-shaped member is twisted and altered to form at least two loops, a first loop of the two loops acts as a picking section including a string-contact part, which contacts the strings of the instrument, a second loop of the two loops acts as a finger-winding section, which is wound and retained on the finger, and a first plane enclosed by the first loop and a second plane enclosed by the second loop are intersected with each other at an angle. With this structure, the picking section and the finger-winding section, which are formed by twisting the wire-shaped member, are integrated, and the stringed instrument playing assistance implement is engaged with the finger by the finger-winding section, so that slippage and dropping of the picking section can be prevented. Further, the planes enclosed by the loops, which respectively act as the picking section and the finger-winding section, are intersected with each other at an angle, so that the stringed instrument playing assistance implement can be easily mounted on the finger and playing the instrument can be easily performed.

Preferably, in the present invention, the picking section can be engaged with a tip of a nail or pressed by a finger pad. With this structure, the wire-shaped member can be altered according to a style of playing, so the stringed instrument playing assistance implement can be used, as an alternative to a pick, e.g., flat pick, thumb pick, finger pick, for playing the stringed instrument.

Preferably, in the present invention, a length of the finger-winding section can be adjusted by twisting the wire-shaped member. With this structure, the wire-shaped member can be altered, so it can be easily twisted and can be fitted to the finger by engaging itself. Further, the engaged wire-shaped member can be disengaged, the wire-shaped member can be altered and formed into a desired shape so as to make a perfect fit of a size for the player's finger, and the wire-shaped member can be reengaged to be mounted on and engaged with the finger.

Preferably, in the present invention, the wire-shaped member is partly or entirely coated with a resin film. With this structure, in case that the stringed instrument has metallic strings and the wire-shaped member is composed of a metallic material, the resin film is capable of preventing direct contact of metallic materials and preventing generation of metallic attack sounds mostly including high-frequency range sounds, e.g., "clicking noise", which are generated by direct contact of metallic materials. Further, nonmetallic attack sounds can be generated as well as playing styles in which nails, fingers or conventional stringed instrument playing assistance implements are used.

Preferably, in the present invention, an outer circumferential shape of a transverse section of the wire-shaped member is formed into a polygonal shape. With this structure, a contact area between the wire-shaped member and the finger can be increased, so that the wire-shaped member can be stably mounted on the finger while playing the stringed instrument.

Preferably, in the present invention, the polygonal shape is a triangular shape. With this structure, an angel of the string-contact part of the wire-shaped member, in the transverse section, can be reduced, i.e., acute angle. By forming the acute angle, a force applied to the strings, which is varied according to severity of a picking force of the player, can be easily adjusted, so that delicate sounds can be easily generated.

Preferably, in the present invention, the string-contact part is bent. By bending the string-contact part, the stringed instrument playing assistance implement is capable of easily picking the strings, and shock resistance and deformation resistance of the string-contact part can be improved, so that the stringed instrument playing assistance implement can withstand shock while playing.

Effects of the Invention

In the present invention, the stringed instrument playing assistance implement can be altered and mounted on a finger, can be adjusted and make a perfect fit of a location, an angle, and a size for any sort of player's finger, and can prevent slippage or falling off said finger.

BRIEF DESCRIPTION OF THE DRAWINGS

FIG. 1A shows the wire-shaped member mounted on a finger seen from one side of the finger, and FIG. 1B is an explanation view in which the wire-shaped member shown in FIG. 1A is detached from the finger.

FIG. 2A is an explanation view of the wire-shaped member mounted on the finger seen from a finger pad side, and FIG. 2B is an explanation view in which the wire-shaped member shown in FIG. 2A is detached from the finger.

FIG. 3A is an explanation view of the wire-shaped member mounted on the finger seen from a nail plate side, and FIG. 3B is an explanation view in which the wire-shaped member shown in FIG. 3A is detached from the finger.

FIG. 7A is an explanation view of the wire-shaped member mounted on the finger seen from the finger pad side, and FIG. 7B is an explanation view in which the wire-shaped member is mounted on an index finger and a picking section is held by a thumb.

FIG. 8A is an explanation view of the wire-shaped member mounted on the finger seen from the nail plate side, and FIG. 8B is an explanation view of the wire-shaped member mounted on the finger seen from the finger pad side.

EMBODIMENTS OF THE INVENTION

Embodiments of the present invention will now be described in detail with reference to the accompanying drawings.

Figure 1A:
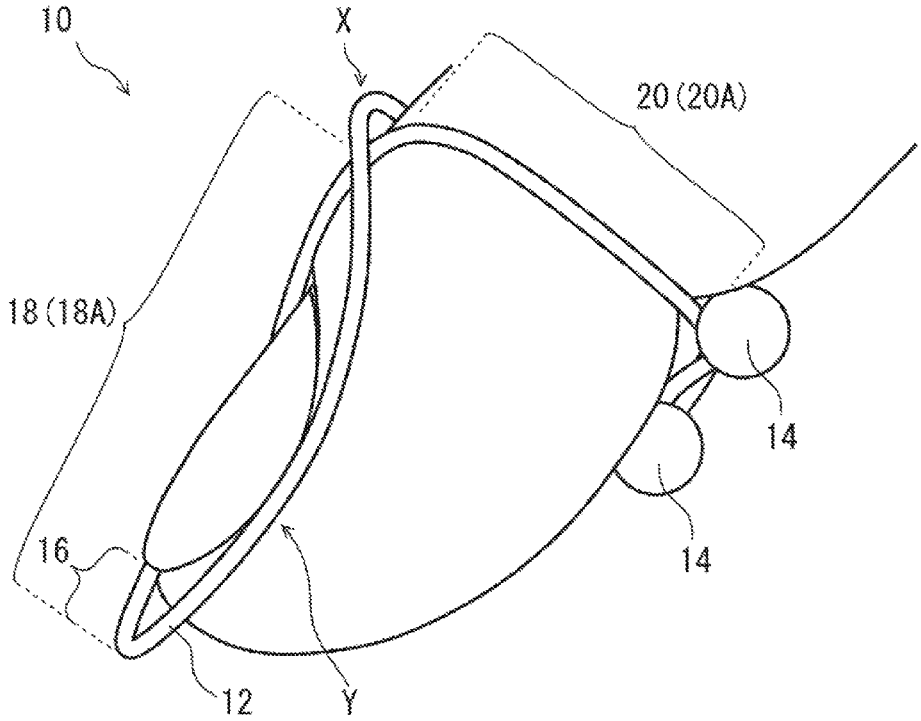
FIGS. 1A and 1B show an embodiment of the stringed instrument playing assistance implement relating to the present invention in which a wire-shaped member is altered.
Figure 1B:
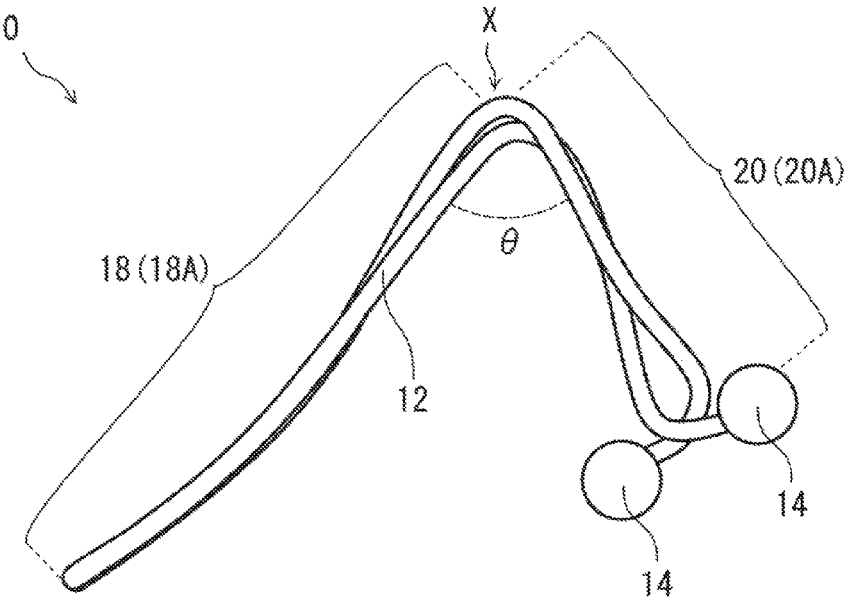
Figure 2A:
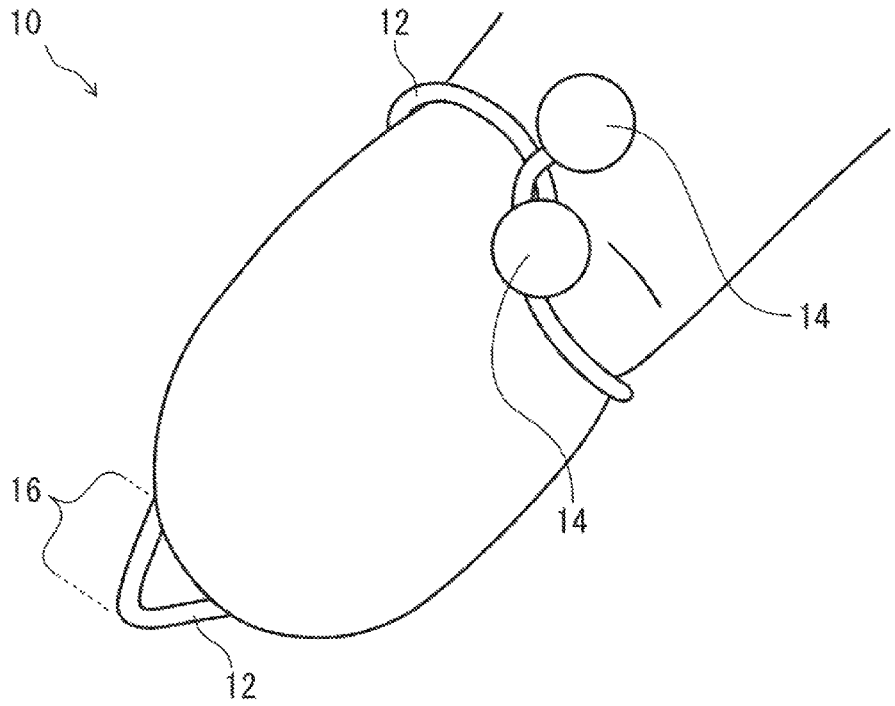
FIGS. 2A and 2B show the embodiment of the stringed instrument playing assistance implement relating to the present invention in which the wire-shaped member is altered.
Figure 2B:
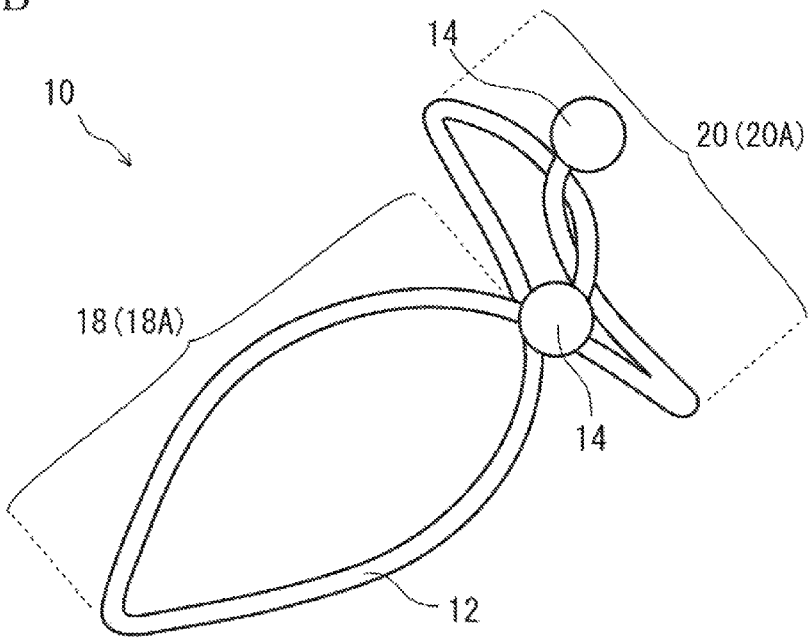
Figure 3A:
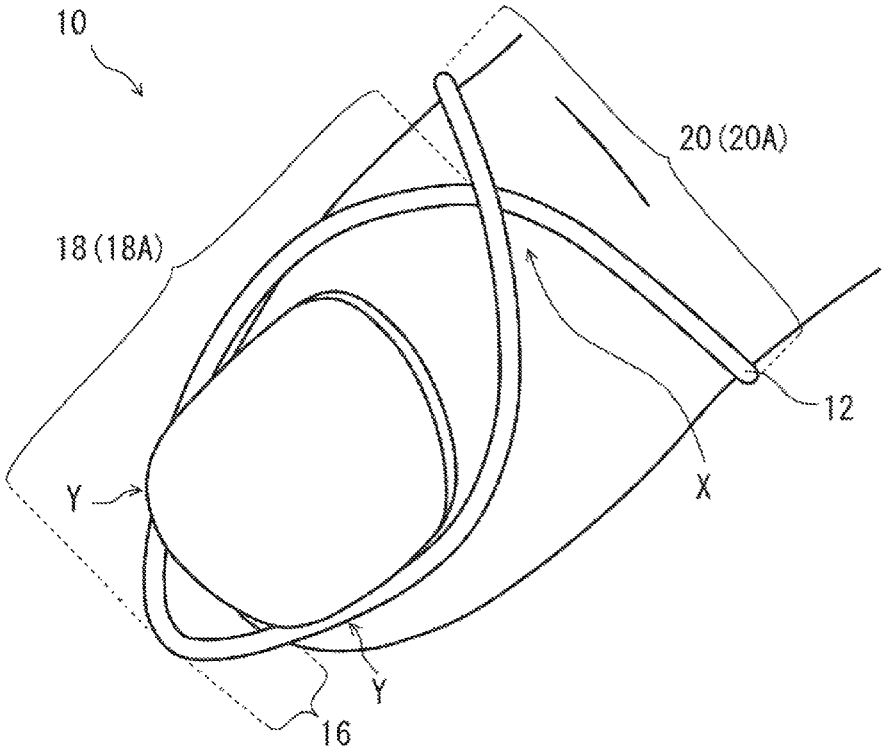
FIGS. 3A and 3B show the embodiment of the stringed instrument playing assistance implement relating to the present invention in which the wire-shaped member is altered.
Figure 3B:
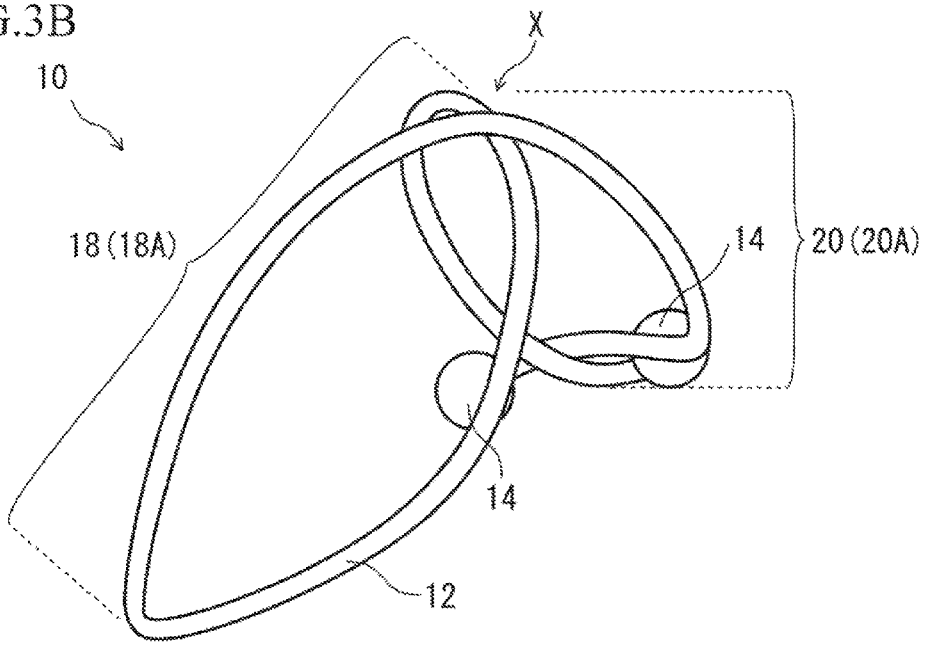

An embodiment of the stringed instrument playing assistance implement 10 relating to the present invention is shown in FIGS. 1A, 1B, 2A, 2B, 3A and 3B, which show a state where an altered wire-shaped member 12 is mounted on a finger and another state where the altered wire-shaped member 12 is dismounted therefrom. In FIGS. 1A, 1B, 2A, 2B, 3A and 3B, the wire-shaped member 12 is mounted on a finger other than a thumb, FIGS. 1A and 1B are views seen from one side of the finger, FIGS. 2A and 2B are views seen from a finger pad side, and FIGS. 3A and 3B are views seen from a nail plate side. Note that, an intersecting state of the twisted wire-shaped member 12 at an intersection point X shown in FIGS. 1A and 1B is different from that shown in FIGS. 3A and 3B, but the stringed instrument playing assistance implement 10 can be used in the both states.

The present embodiment is characterized in that the wire-shaped member 12 is used as the stringed instrument playing assistance implement 10 for playing a stringed instrument, it is different from the conventional implements, and the wire-shaped member 12 can be altered and mounted on a finger and can retain a shape thereof. Since the wire-shaped member is mounted on the finger and can retain the shape, strings of the stringed instrument can be picked without deforming the wire-shaped member 12 while playing, so the wire-shaped member can be used as the stringed instrument playing assistance implement 10 without any difficulty. Further, by changing the shape of the wire-shaped member 12, the stringed instrument playing assistance implement can be used as well as a flat pick and a thumb pick and can be mounted on a thumb, an index finger and other fingers.

The wire-shaped member 12 may be optionally altered as far as the wire-shaped member can be mounted on the finger, but the shape of the wire-shaped member 12 should be adjusted according to sizes of the finger and a nail, a shape of the finger, etc. The shape of the wire-shaped member 12 can be changed by bending and twisting the wire-shaped member 12. Unlike the conventional implements whose length is adjusted by changing the clearance between holes or grooves of the belt according to a size of a finger of a player, the wire-shaped member 12 can be altered at any positions, so the length of the wire-shaped member can be steplessly adjusted. With this structure, unlike the conventional pick which can be mounted on only a thumb or an index finger, the wire-shaped member 12 which has been optionally altered can be mounted on any fingers. By mounting the wire-shaped member 12 on the finger of the player, the player can focus on playing without feeling a slight difference between sizes of the finger and the stringed instrument playing assistance implement 10, and slippage and dropping of the stringed instrument playing assistance implement 10 can be prevented.

Engage members 14, which can be engaged with each other, may be respectively provided to both ends of the wire-shaped member 12 integrally or separately. To engage the engage members 14 with each other, parts of the wire-shaped member 12 near the engage members 14 may be altered by twisting. By providing the engage member 14, the wire-shaped member can be easily twisted with pressing the engage members 14, and the engage members 14 can be easily engaged with each other by altering the wire-shaped member 12. Since the wire-shaped member can be easily altered by the engage members 14, a length of the wire-shaped member 12 can be easily adjusted, and stepless adjustment of the length with respect to the finger can be easily performed. Therefore, the engage members 14 which have been engaged with each other are not disengaged while playing, the stringed instrument playing assistance implement 10 can be retained on the finger, and a feeling of stability can be improved. Further, the stringed instrument playing assistance implement can be easily dismounted from the finger by pressing and twisting the engage members 14 being engaged with each other by fingers. Note that, for example, the shape of the engage members 14 shown in FIGS. 1A, 1B, 2A, 2B, 3A and 3B is formed into a spherical shape, but the shape is not limited.

Figure 4:
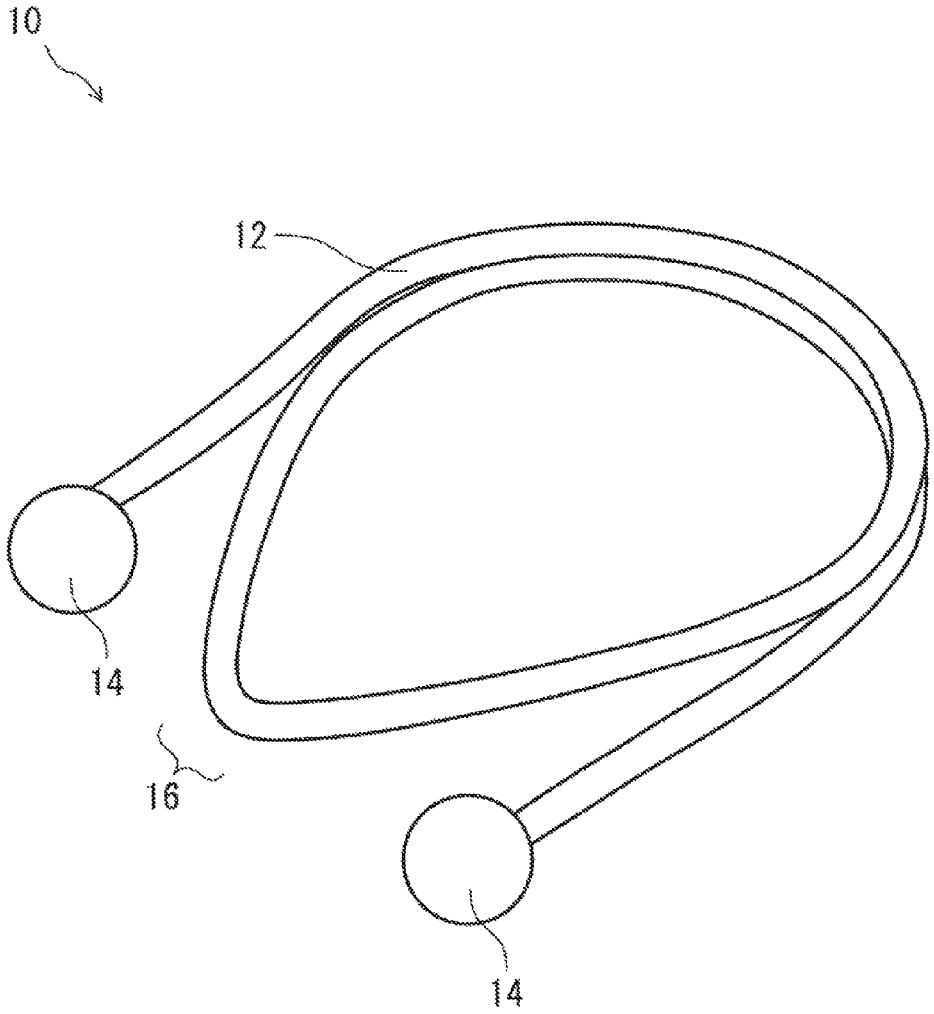
FIG 4 is an explanation view of another example of the wire-shaped member relating to the present invention.

Another example of the wire-shaped member 12 relating to the present invention is shown in FIG. 4, in which the wire-shaped member 12 is not mounted on a finger. FIG. 4 shows the wire-shaped member 12, which is in the form of a commercial product, before being mounted on the finger of the player, i.e., before being altered and mounted on the finger as shown in FIGS. 1A, 1B, 2A, 2B, 3A and 3B. Note that, the wire-shaped member may be returned to its original shape and accommodated after completing the playing. In the original state, the engage members 14 may be located at the both ends of the wire-shaped member 12, or the wire-shaped member 12 may penetrate through the engage members 14 so as to locate them midway. The engage members need not be provided to the both ends of the wire-shaped member 12, the engage members may be detached from the wire-shaped member 12 when being sold as a commercial product, and the engage members 14 may be attached after altering the wire-shaped member 12. In case that the engage members 14 are respectively integrated to the both ends of the wire-shaped member 12, injury by the ends of the wire-shaped member 12 can be prevented, and breaking a packing material of the commercial product can be prevented in a distribution process. A size of the engage members 14 is not limited as far as the engage members do not cause inconvenience for the player. The length of the wire-shaped member 12 is not limited, so the wire-shaped member 12 may be cut to a suitable length according to a size of the finger of the player or a mounting style.

By twisting and altering the wire-shaped member 12, at least two loops are formed. One of the loops is a first loop 18A and acts as a picking section 18 including a sting-contact part 16, which will contact the strings of the stringed instrument. Another loop other than the first loop 18A is a second loop 20A and acts as a finger-winding section 20, which will be wound on the finger. By forming t into the loop shape, so that the second loop can be wound on and retained on the finger. Further, the wire-shaped member is constituted by one wire, so the picking section 18 and the finger-winding section 20 are integrated, and the wire-shaped member 12 can be mounted and fitted on fingers of any sort of players even if entire shapes of fingers of players are different. By forming the loops and winding one of the loops on the finger, the finger and the wire-shaped member 12 contact each other without looseness, so stability of fitting on the finger can be improved while playing.

A first plane enclosed by the first loop 18A and a second plane enclosed by the second loop 20A are intersected with each other at an angle. Concretely, as shown in FIGS. 1A and 1B, the first plane and the second plane are not in a same plane, the wire-shaped member 12 is bent at the intersection point X, at which the wire-shaped member itself is overlapped and intersected, with an angle of θ. With this structure, the loop of the wire-shaped member 12 can be wound on the finger as the finger-winding section 20, and the picking section 18 can pick the stringed instrument for playing.

Figure 5:
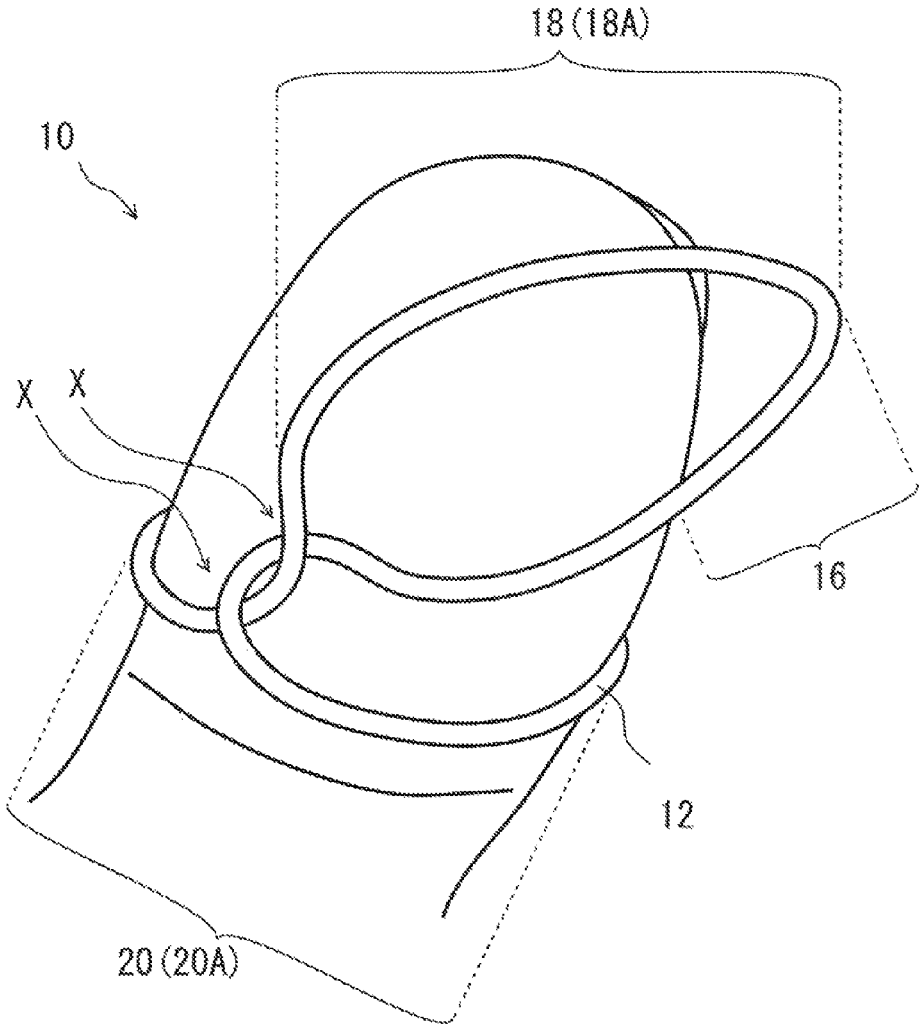
FIG 5 is an explanation view of another embodiment of the stringed instrument playing assistance implement relating to the present invention in which the wire-shaped member is altered and mounted on the finger.

Another embodiment of the stringed instrument playing assistance implement 10 is shown in FIG. 5, it is different from that shown in FIGS. 1A, 1B, 2A, 2B, 3A and 3B, and the wire-shaped member 12 is mounted on a thumb. In each of the embodiments shown in FIGS. 1A, 1B, 2A, 2B, 3A, 3B and 5, the picking section 18 of the wire-shaped member 12 can be engaged with a tip of a nail or pressed by a finger pad. In the altered wire-shaped members 12 shown in FIGS. 1A, 1B, 3A and 3B, a part of the picking section 18 can be engaged with a tip Y of the nail. With this structure, the playing can be performed in a state where the picking section 18 is engaged with the finger, so that the strings can be strongly picked, by the stringed instrument playing assistance implement 10, without looseness of the picking section 18. As to the wire-shaped member 12 shown in FIG. 5, the overlapping and intersecting points X and the picking section 18 of the wire-shaped member 12 is located on a finger pad side, so that the playing can be performed by the string-contact part 16 with pressing the picking section 18 by the finger pad.

Further, in the embodiment shown in FIGS. 1A, 1B, 2A, 2B, 3A and 3B, the wire-shaped member 12 is altered so as to locate the string-contact part 16 near the tip of the nail; on the other hand, in the embodiment shown in FIG. 5, the wire-shaped member 12 is altered to shift the string-contact part 16 from the tip of the nail toward the side thereof. In case that the wire-shaped member 12 is altered so as to change the position of the string-contact part 16 as shown in FIGS. 1A, 1B, 2A, 2B, 3A and 3B, the stringed instrument playing assistance implement can be used as well as a finger pick. Further, by altering the wire-shaped member 12 as shown in FIG. 5, the picking section 18 can be held by an index finger in the state where the stringed instrument playing assistance implement is mounted on the thumb, as well as a flat pick.

A length of the finger-winding section 20 can be adjusted by twisting the overlapped part of the wire-shaped member 12. Further, the engage members 14, which are provided to the wire-shaped member 12, may be twisted so as to adjust said length. By twisting, the wire-shaped member 12 or the engage members 14 are engaged with each other, so that the length of the finger-winding section 20 can be steplessly adjusted according to a size and a shape of the finger. Further, the finger-winding section can be easily loosened. Therefore, the player is capable of shaping the implement into a suitable shape which is preferable and convenient for the playing.

Figure 6A:
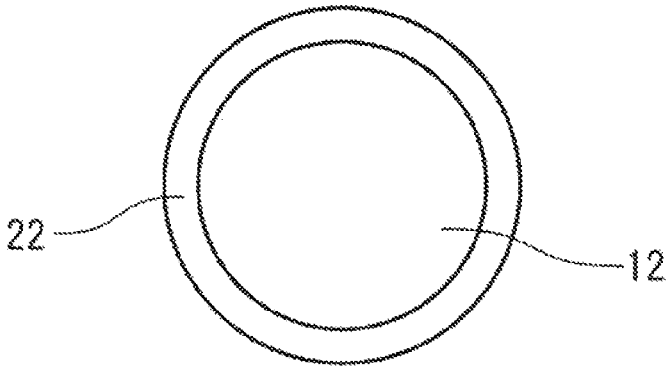
FIGS. 6A-6C are explanation views showing transverse sections of the wire-shaped members coated with resin films.
Figure 6B:
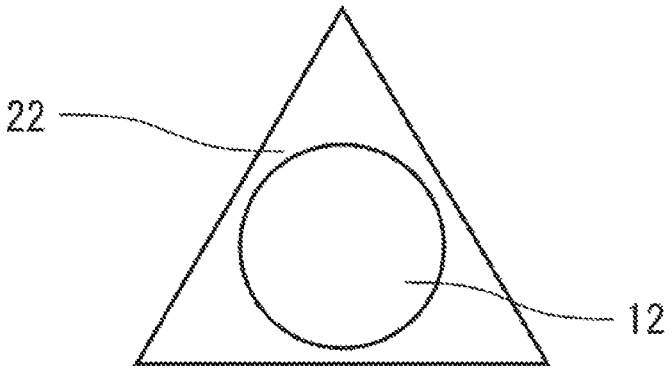
Figure 6C:
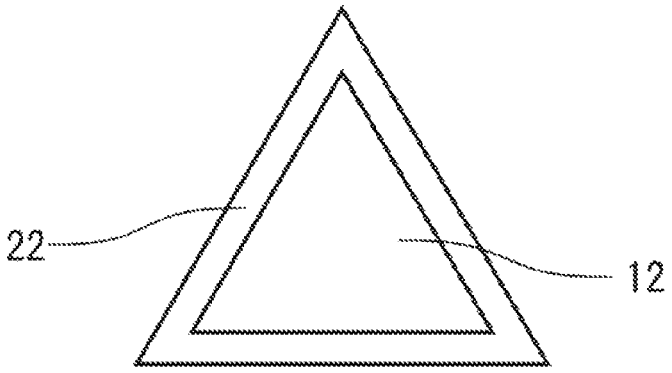

FIGS. 6A-6C show transverse sections of the wire-shaped members 12 relating to the present invention, the wire-shaped members 12 are coated with resin films 22, and each of the wire-shaped members 12 is partially or entirely coated with the resin films 22. The stringed instrument is picked, by colliding the wire-shaped member 12 with the strings, for the playing, but metallic attack sounds mostly including high-frequency range sounds, e.g., "clicking noise", which are generated by direct contact of metallic materials, will be easily generated when playing a stringed instrument having metallic strings with the wire-shaped member 12 having a metallic surface. Thus, by forming the resin films 22 on at least the string-contact part 16 of the wire-shaped member 12, generation of the metallic attack sounds can be prevented. Therefore, nonmetallic attack sounds can be generated as well as playing styles using nails, fingers or picks.

FIG. 6A shows the transverse section of the wire-shaped member 12 having a circular outer circumferential shape, and the resin film 22 is circularly formed. Preferably, the outer circumferential shape of the transverse section of the wire-shaped member 12 is formed into a polygonal shape, and the outer circumferential shape of the transverse section of the wire-shaped member 12 coated with the resin film 22 is also formed into a polygonal shape. The resin film 22 coats the wire-shaped member 12, and the outer circumferential shape of the wire-shaped member 12 can be formed into various shapes. In case that the outer circumferential shape of the transverse section of the wire-shaped member 12 or the outer circumferential shape of the transverse section of the wire-shaped member 12 coated with the resin film 22 is formed into a polygonal shape, a feeling of stability of the stringed instrument playing assistance implement on the finger can be improved, and the player can satisfactorily play.

Preferably, the outer circumferential shape of the transverse section of the wire-shaped member coated with the resin film 22 is formed into a triangular shape as shown in FIGS. 6B and 6C. In case that the transverse section of the wire-shaped member 12 coated with the resin film 22 has a contact point which can contact the strings of the stringed instrument and which is formed at an acute angle, it is easier to pick the strings of the stringed instrument by the contact point having the acute angle than to pick the same by a contact point having a linear shape, an obtuse angle or an arcuate shape outwardly curved. Therefore, delicate and rich sounds can be easily generated by sensitive actions of the stringed instrument playing assistance implement 10 which is performed by the player.

A size of the transverse section of the wire-shaped member 12 is not limited as far as the wire-shaped member can be altered and fixed, and the size may be optionally defined as far as the wire-shaped member can be fitted between a nail and a finger in case that the wire-shaped member is engaged with a tip of the nail to play the stringed instrument. Similarly, a thickness of the resin film 22 is not limited, either. The resin film 22 is formed, for example, by inserting the wire-shaped member 12 into a heat shrinkable tube and heating the tube or by dipping the wire-shaped member into molten resin. Further, the transverse section of the wire-shaped member 12 can be formed into the circular shape or the polygonal shape by, for example, an extrusion molding method.

The string-contact part 16 of the stringed instrument playing assistance implement 10, which can contact the strings of the stringed instrument, may be bent at an axial middle of the wire-shaped member. The string-contact part 16 of the stringed instrument playing assistance implement 10 may be used in a state where the contact part is located to correspond to the tip of the finger, or the string-contact part 16 may be used in a state where the contact part projects from a side of the finger like a thumb pick. The position of the string-contact part 16 can be changed according to the playing style, the wire-shaped member 12 can be altered with using the string-contact part as a bending mark, and the wire-shaped member 12 can be easily mounted on the finger. Further, by bending the string-contact part 16 at the axial middle, shock resistance and deformation resistance of the string-contact part can be increased, so that the string-contact part can withstand shock of picking, without inconvenience, while playing.

The stringed instrument playing assistance implement 10 of the present embodiment can be applied to pick-holding manners corresponding to various playing styles. Unlike the conventional stringed instrument playing assistance implements, e.g., an artificial nail adhered on a nail by an adhesive, an implement directly fixed on a nail by a retainer, the stringed instrument playing assistance implement 10 of the present embodiment is altered and mounted on a finger, so that damaging nail can be reduced.

Figure 7A:
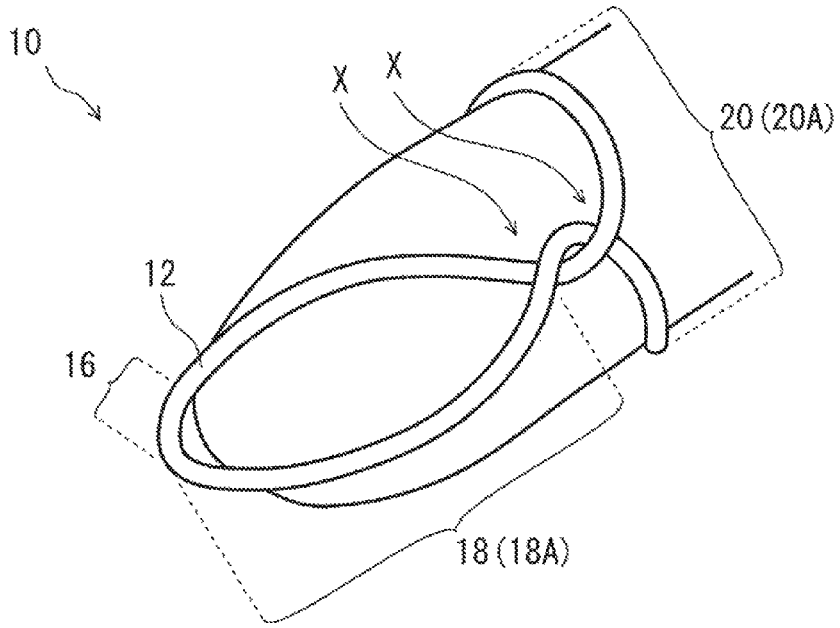
FIGS. 7A and 7B show another embodiment of the stringed instrument playing assistance implement relating to the present invention in which the wire-shaped member is altered.
Figure 7B:
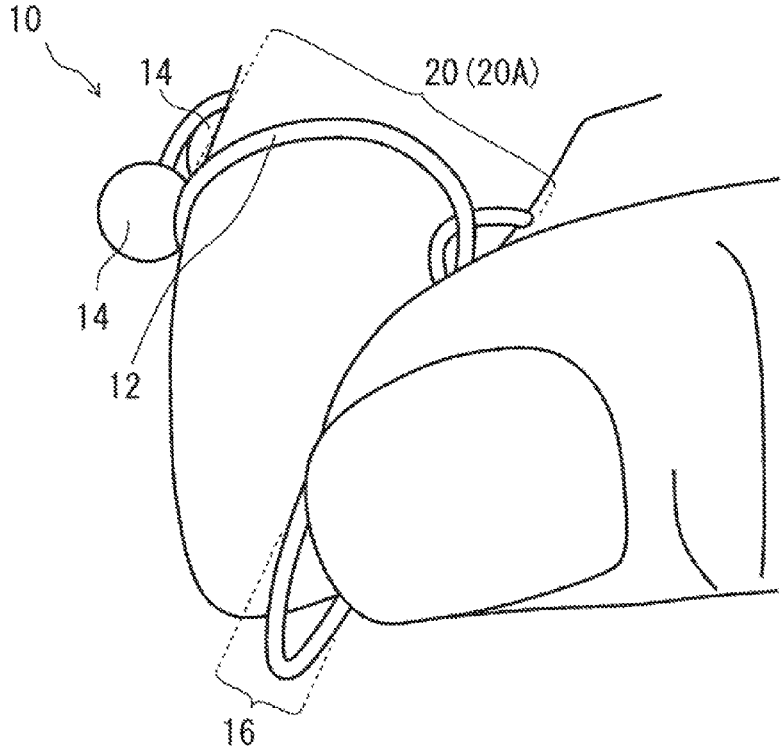

FIGS. 7A and 7B are explanation views of another embodiment of the stringed instrument playing assistance implement 10 of the present invention, in which the stringed instrument playing assistance implement is mounted on an index finger and the picking section 18 is held by a thumb. Unlike the embodiment shown in FIGS. 1A, 1B, 2A, 2B, 3A and 3B, the wire-shaped member 12 described in each of the embodiments shown in FIGS. 5, 7A and 7B has two intersection points X, at which the wire-shaped member 12 itself is overlapped and intersected. By twisting the wire-shaped member 12 twice, number of the intersection points X, at which the wire-shaped member 12 itself is overlapped and intersected, is increased, so that the shape of the bent part can be stabilized and the intersection angle between the first plane enclosed by the picking section 18 and the second plane enclosed by the finger-winding section 20 can be easily maintained. With this structure, even if the picking section 18 picks the strings while playing, the shape of the wire-shaped member 12 can be retained and the playing can be easily performed. The effect of retaining the shape of the wire-shaped member 12 can be obtained in the embodiment shown in FIG. 5 too, where the wire-shaped member 12 is mounted on the thumb, so that the playing can be performed without looseness of the picking section 18.

Figure 8A:
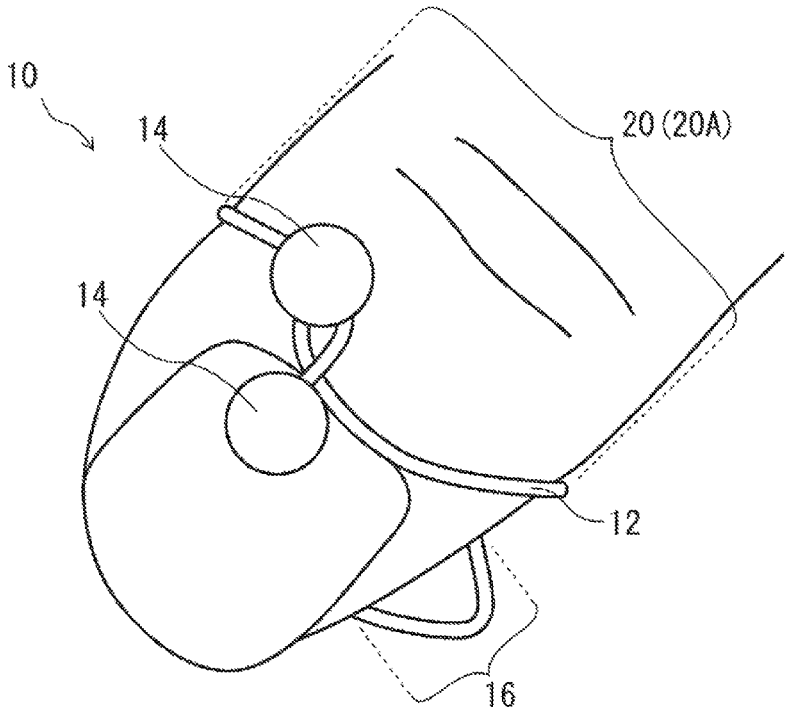
FIGS. 8A and 8B show a further embodiment of the stringed instrument playing assistance implement relating to the present invention in which the wire-shaped member is altered.
Figure 8B:
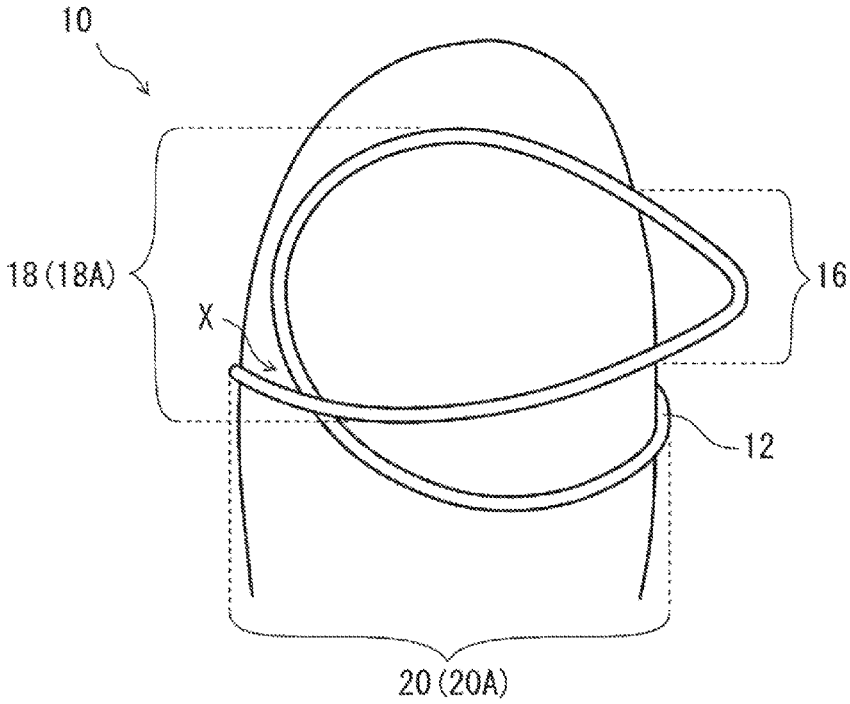

FIGS. 8A and 8B show a further embodiment of the stringed instrument playing assistance implement 10 of the present embodiment, and the altered wire-shaped member 12 is shown. In FIGS. 8A and 8B, the stringed instrument playing assistance implement 10 is mounted on a thumb. By altering the string-contact part 16 toward a side of a nail, the playing can be performed in a state where the stringed instrument playing assistance implement is held like a thumb pick and pressed by a finger pad. In FIGS. 8A and 8B, number of the intersection point X, at which the wire-shaped member 12 itself is overlapped and intersected, is one, but the number of the intersection point X may be two or more like the wire-shaped member 12 shown in FIG. 5.

The stringed instrument playing assistance implements 10 of the above described embodiments can be variously modified according to playing styles, and the present invention is not limited to the embodiments shown in FIGS. 1A, 1B, 2A, 2B, 3A, 3B, 5, 7A, 7B, 8A and 8B. The altered wire-shaped member 12 of the stringed instrument playing assistance implements 10 can be mounted on the thumb as shown in FIGS. 5, 8A and 8B and other fingers other than the thumb as shown in FIGS. 1A, 1B, 2A, 2B, 3A, 3B, 7A and 7B, and the picking section 18 can be engaged with the tip of the nail (see FIGS. 1A, 1B, 2A, 2B, 3A and 3B) or can be pressed by the finger pad (see FIGS. 5, 7A, 7B, 8A and 8B). Therefore, the intersection point X, at which the wire-shaped member 12 itself is overlapped and intersected, may be located on the nail side of the finger (see FIGS. 1A, 1B, 2A, 2B, 3A and 3B), on the pad side of the finger (see FIGS. 5, 7A and 7B) and the side of the finger (see FIGS. 8A and 8B). Further, the engage members 14 may be located at convenient positions for the player, e.g., on the nail side of the finger (see FIGS. 5, 7A, 7B, 8A and 8B), on the pad side of the finger (see FIGS. 1A, 1B, 2A, 2B, 3A and 3B) and the side of the finger. Note that, in case that the implement is mounted on the thumb, there is a possibility that the engage members 14 are caught by the strings if the engage members 14 are located on the finger pad side, so the wire-shaped member should be altered to located the engage members 14 at suitable positions where the engage members are not caught by the strings. With the above described structures, the stringed instrument playing assistance implements 10 can be applied to various playing styles, e.g., combination style of the finger style and the pick style, and complex or high-level playing can be performed by mounting a plurality of the stringed instrument playing assistance implements on fingers.

Figure 9:
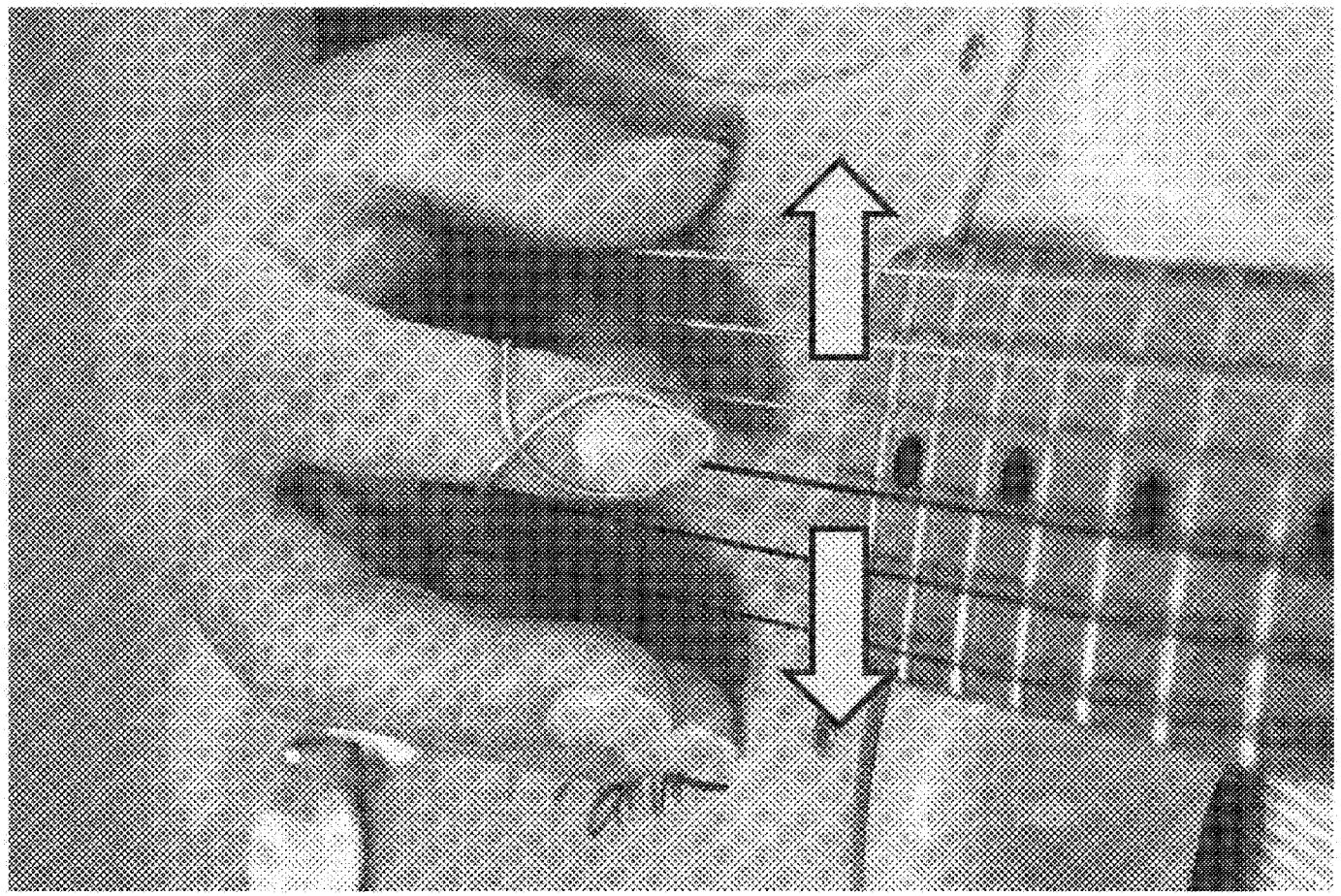
FIG 9 shows the stringed instrument playing assistance implement relating to the present invention and an example of a mounting manner and a picking manner for playing a guitar.
Figure 10:
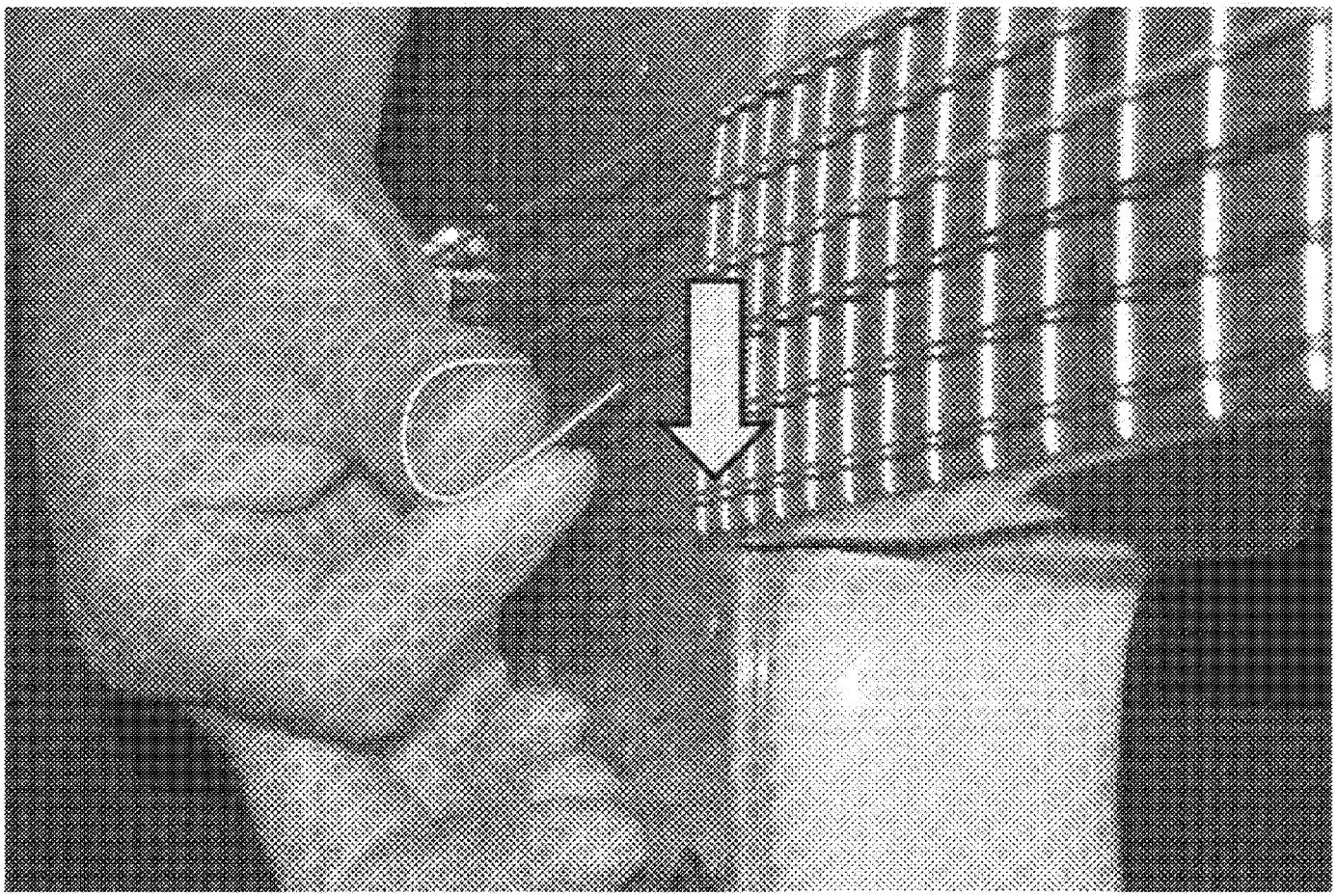
FIG.10 PRIOR ART
FIG 10 shows the conventional thumb pick and an example of a mounting manner and a picking manner for playing a guitar.
Figure 11:
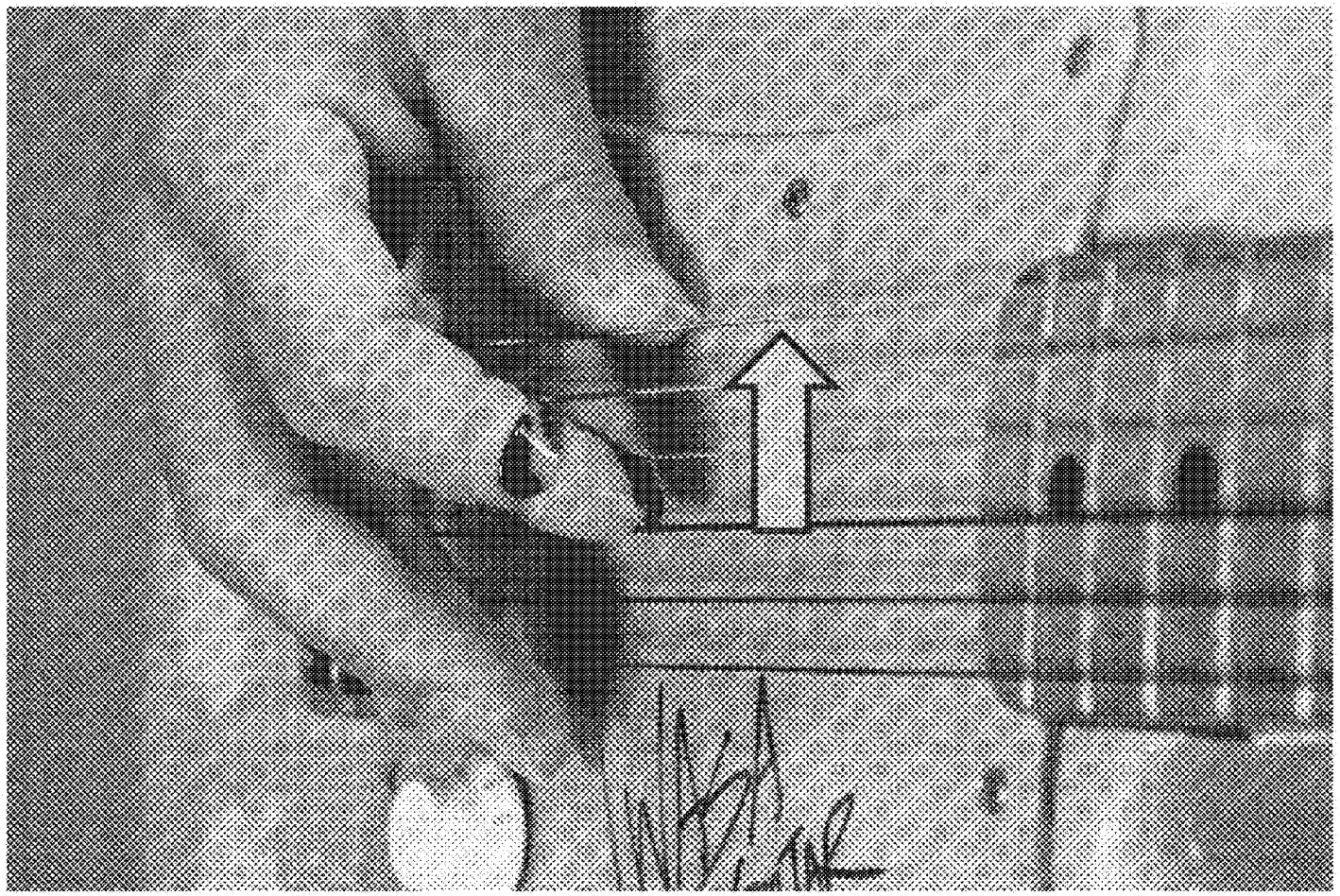
FIG.11 PRIOR ART
FIG 11 shows the conventional finger pick and an example of a mounting manner and a picking manner for playing a guitar.

An example of the manner of mounting the stringed instrument playing assistance implements for picking strings will be explained with reference to FIG. 9. Unlike the conventional finger pick shown in FIG. 11, the wire-shaped member 12 shown in FIG. 9 is mounted as if to cover the finger from the both sides, and the string-contact part is located in front of the tip of the nail, so that the strings can be picked in both directions of arrows shown in FIG. 9.

A material of the wire-shaped member 12 of the stringed instrument playing assistance implements 10 of the present invention is not limited, but a preferable material is a shape-retainable metallic wire composed of, for example, copper, nickel, or a magnetic material, e.g., stainless steel 316L, piano wire, steel. The resin film may be composed of synthetic resin (plastic) having high abrasion resistance and high shock resistance, e.g., fluorine resin, polyamide resin. Further, polyacetal, polypropylene, high density polyethylene, polyvinyl chloride, Kynar (trademark) or nylon may be employed as the material of the resin film. The engage members 14 may be composed of a metal, e.g., stainless steel 316L, a magnetic material, e.g., steel, synthetic resin or synthetic rubber.

As described above, the following problems of the conventional picks can be solved by the stringed instrument playing assistance implements 10 of the present invention. As to the conventional flat pick, the player will get more and more tired and slippage and dropping of the flat pick will be easily caused by sweat when continuously holding the flat pick. As to the conventional thumb pick, a size of a mounting section to be mounted on the finger and a holding position are fixed, so a mounting angle and a holding style cannot be changed. Further, as to the conventional finger pick, the structure is not suitable for the stroke performance, in which playing is performed by moving a wrist and an arm, etc., and a position of a holding section and the size of the pick are fixed. On the other hand, the stringed instrument playing assistance implements 10 of the present invention can be mounted on the finger without being held, so that slippage and dropping of the implement can be prevented and the combined style of the finger style and the pick style can be performed. Further, the stringed instrument playing assistance implements can be adjusted to make a perfect fit of a location, an angle, and a size for any sort of player's finger. The stringed instrument playing assistance implements can be applied to various picking styles and various playing manners.

What is claimed is:

1. A stringed instrument playing assistance implement, which is employed when playing a stringed instrument by picking the strings thereof, comprising:

a wire-shaped member, which can be altered and mounted on a finger and which is capable of retaining a shape, wherein the wire-shaped member is twisted and altered to form at least two loops, a first loop of the two loops acts as a picking section including a string-contact part, which contacts the strings of the instrument, a second loop of the two loops acts as a finger-winding section, which is wound and retained on the finger, and a first plane enclosed by the first loop and a second plane enclosed by the second loop are intersected with each other at an angle.

2. The stringed instrument playing assistance implement according to claim 1, wherein engage members, which can be engaged with each other, are integrally or separately provided to both ends of the wire-shaped member.

3. The stringed instrument playing assistance implement according to claim 1, wherein the picking section can be engaged with a tip of a nail or pressed by a finger pad.

4. The stringed instrument playing assistance implement according to claim 2, wherein the picking section can be engaged with a tip of a nail or pressed by a finger pad.

5. The stringed instrument playing assistance implement according to claim 1, wherein a length of the finger-winding section can be adjusted by twisting the wire-shaped member.

6. The stringed instrument playing assistance implement according to claim 2, wherein a length of the finger-winding section can be adjusted by twisting the wire-shaped member.

7. The stringed instrument playing assistance implement according to claim 3, wherein a length of the finger-winding section can be adjusted by twisting the wire-shaped member.

8. The stringed instrument playing assistance implement according to claim 4, wherein a length of the finger-winding section can be adjusted by twisting the wire-shaped member.

9. The stringed instrument playing assistance implement according to claim 1, wherein the wire-shaped member is partly or entirely coated with a resin film.

10. The stringed instrument playing assistance implement according to claim 2, wherein the wire-shaped member is partly or entirely coated with a resin film.

11. The stringed instrument playing assistance implement according to claim 5, wherein the wire-shaped member is partly or entirely coated with a resin film.

12. The stringed instrument playing assistance implement according to claim 1, wherein an outer circumferential shape of a transverse section of the wire-shaped member is formed into a polygonal shape.

13. The stringed instrument playing assistance implement according to claim 2, wherein an outer circumferential shape of a transverse section of the wire-shaped member is formed into a polygonal shape.

14. The stringed instrument playing assistance implement according to claim 5, wherein an outer circumferential shape of a transverse section of the wire-shaped member is formed into a polygonal shape.

15. The stringed instrument playing assistance implement according to claim 12, wherein the polygonal shape is a triangular shape.

16. The stringed instrument playing assistance implement according to claim 13, wherein the polygonal shape is a triangular shape.

17. The stringed instrument playing assistance implement according to claim 14, wherein the polygonal shape is a triangular shape.

18. The stringed instrument playing assistance implement according to claim 1, wherein the string-contact part is bent.

19. The stringed instrument playing assistance implement according to claim 2, wherein the string-contact part is bent.

20. The stringed instrument playing assistance implement according to claim 5, wherein the string-contact part is bent.

* * * * *